United States Patent [19]

Porter

[11] Patent Number: 4,744,778

[45] Date of Patent: May 17, 1988

[54] MARINE ENGINE EXHAUST MUFFLER WITH SWIM PLATFORM

[75] Inventor: Victor B. Porter, Decatur, Ind.

[73] Assignee: Thunderbird Products Corporation, Decatur, Ind.

[21] Appl. No.: 887,343

[22] Filed: Jul. 21, 1986

[51] Int. Cl.[4] ..... B63H 21/32

[52] U.S. Cl. ..... 440/89; 114/343; 181/235

[58] Field of Search ..... 440/89; 181/235; 114/343

[56] References Cited

U.S. PATENT DOCUMENTS

| | | | |
|---|---|---|---|
| 830,908 | 9/1906 | Martin | 440/89 |
| 1,065,707 | 6/1913 | Montgomery | 181/235 |
| 3,452,704 | 7/1969 | Watkins | 440/89 |
| 3,599,595 | 8/1971 | James | 440/89 |
| 3,742,895 | 7/1973 | Horiuchi | 440/89 |
| 4,002,136 | 1/1977 | Michalak | 181/235 |
| 4,167,987 | 9/1979 | Turner | 181/235 |
| 4,586,908 | 5/1986 | Schlichthorst | 440/89 |

FOREIGN PATENT DOCUMENTS

| | | | |
|---|---|---|---|
| 622414 | 5/1949 | United Kingdom | 440/89 |

OTHER PUBLICATIONS

Conroy X19 boat ad.

*Primary Examiner*—Joseph F. Peters, Jr.
*Assistant Examiner*—Thomas J. Brahan
*Attorney, Agent, or Firm*—Pearne, Gordon, McCoy & Granger

[57] ABSTRACT

An exhaust muffler for mounting on the transom of an inboard or inboard/outboard motor boat over the exhaust pipes which extend through the transom includes a top which forms a swim platform. The muffler comprises a housing which has a pair of sidewalls each adjacent to one of the sides of the boat, so that the housing is approximately equal in width with the width of the boat at the stern. The top of the housing forms the swim platform which provides a functional and attractive appearance to the exterior muffler.

10 Claims, 5 Drawing Sheets

MARINE ENGINE EXHAUST MUFFLER WITH SWIM PLATFORM

BACKGROUND OF THE INVENTION

1. Field of the Invention

This invention relates to an exhaust muffler for use on marine engines of the type found on inboard and inboard/outboard motor boats, and specifically to an exhaust muffler which also forms a swim platform at the stern of the boat.

2. Description of the Prior Art

Inboard and inboard/outboard motor boats typically have a plurality of exhaust pipes extending through the transom at the stern of the boat. These exhaust pipes are typically located at or above the water line. With larger size marine engines, the exhaust noise emanating from the exhaust pipes can be substantial. Such exhaust noise is often disturbing to occupants of the boat, to water skiers who are following the boat, to other boaters, and to nearby residents. Thus, it is desirable to provide a muffler at the stern of the boat to reduce the noise of the engine exhaust.

Examples of mufflers located at the stern of inboard motor boats can be found in the following: U.S. Pat. Nos. 3,187,836, issued to Parker on June 8, 1965; 3,291,252, issued to Davis on Dec. 13, 1966; 4,022,136, issued to Michalak, on Jan. 11, 1977; and 4,310,067, issued to Thomson on Jan. 12, 1982.

While such devices provide suitable exhaust muffling capabilities, they do not add to the appearance of the boat and, in fact, often detract from the appearance of the boat and provide no other suitable functional capabilities to the boat.

SUMMARY OF THE INVENTION

The present invention provides an exhaust muffler for an inboard or inboard/outboard motor boat which provides added capabilities beyond those provided in exhaust mufflers of the prior art. The exhaust muffler of the present invention also provides a swimming and diving platform located at the stern of the boat. The platform projects rearwardly from the boat slightly above the water level and facilitates entering and exiting the boat from the water when the engines are shut off. Water skiers may use the platform as a staging area prior to entering the water for skiing with the engines shut off.

Thus, the exhaust muffler of the present invention provides a desirable and attractive swimming and diving platform extending aft from the boat providing dual capabilities of a quieter exhaust and ease of entering and exiting the boat while it is in the water and the engines are shut off.

These and other capabilities are provided by the present invention of an exhaust muffler for a motor boat having an exhaust pipe extending through the transom at the stern. The muffler comprises a housing located at the stern of the boat over the exhaust pipe. The housing comprises a pair of sidewalls each adjacent to one of the sides of the boat and extending aft of the transom. The housing also comprises a top extending between the two sidewalls below the top of the transom and above the exhaust pipe. The top is above the water line and forms a swimming platform. The housing also comprises a bottom extending between the two sidewalls. The housing also comprises a rear wall located aft of the transom and having an exhaust port for the exiting of the exhaust from the exhaust pipes. Muffler means are located within the housing for reducing the level of the noise from the exhaust port in the housing.

DETAILED DESCRIPTION OF THE PREFERRED EMBODIMENTS

Figure 1:
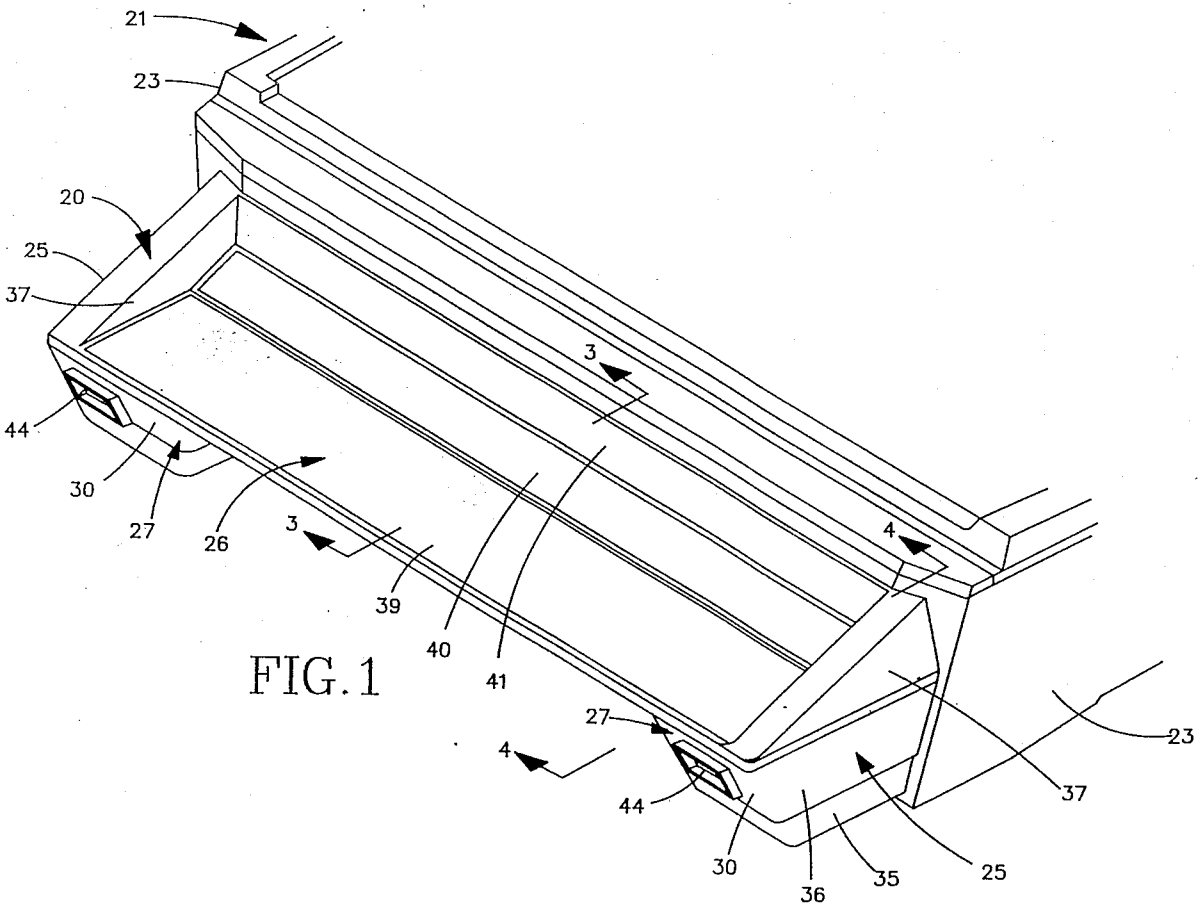
FIG. 1 is a perspective view of the exhaust muffler of the present invention mounted at the stern of a motor boat.

Referring more particularly to the drawings and initially to FIG. 1, there is shown the muffler 20 of the present invention mounted at the stern of a motor boat 21. The motor boat 21 is a conventional inboard or inboard/outboard motor boat having a marine engine mounted within the boat and having a plurality of exhaust pipes 22 (FIGS. 3, 4) extending aft. The stern of the boat 21, as shown in FIG. 1, includes a pair of sides 23 and a transom 24. The exhaust pipes 22 extend through the transom 24 of the boat below the water line. In the motor boat 21 shown in FIG. 1, there are four exhaust pipes.

Figure 2:
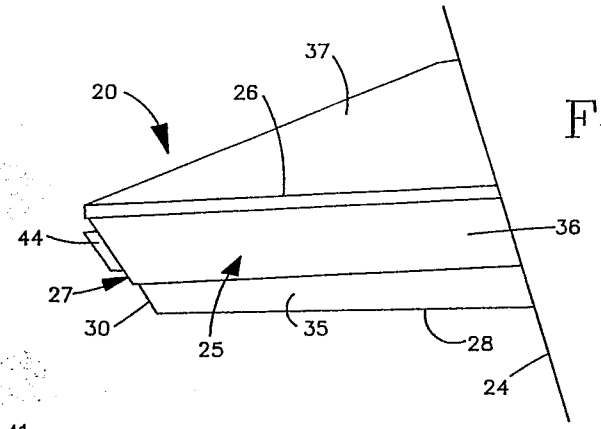
FIG. 2 is a side elevational view of the muffler of FIG. 1.
Figure 4:
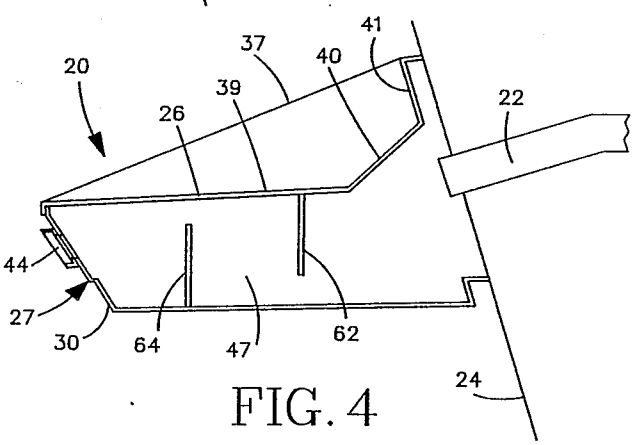
FIG. 4 is a side sectional view taken along line 4—4 of FIG. 1.
Figure 3:
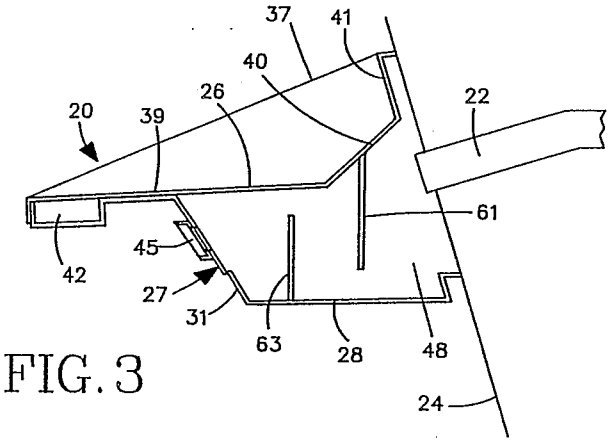
FIG. 3 is a side sectional view taken along line 3—3 of FIG. 1.

The muffler 20 mounts on the transom 24 of the boat 21 and extends rearwardly from the transom. As shown in FIG. 1, the muffler 20 comprises a housing having a pair of sidewalls 25, a top 26 and a rear wall 27. As shown in FIGS. 2, 3 and 4, the housing also comprises a bottom 28. The housing may also include a forward wall 29 adjacent to the transom 24 and having openings through which the exhaust pipes 22 extend. The housing may be formed of the same material used in the hull of the boat, such as fiberglass, or it may be made of aluminum or other suitable laminating material.

The sidewalls 25 each extend aft from the transom 24 and are generally adjacent to the sides 23 of the boat, so that the muffler 20 extends from side to side across the stern of the boat 21 and is approximately equal in width to the width of the boat at the stern. As shown in FIGS. 1 and 2, each sidewall 25 comprises lower sidewall portions 35 and 36 and an upper sidewall brace portion 37. The upper sidewall portion 37 extends from near the top of the transom 24 to the rearward edge of the top 26 and provides a support for the top as it functions as a swimming platform.

The top 26, which extends rearwardly from the transom 24 provides a swimming and diving platform at the stern of the boat which may be conveniently used for entering and exiting the boat and as a staging area for water skiing. As with other swimming and diving platforms which are mounted on the stern of motor boats, the platform formed by the top 26 should be located above the water line but sufficiently close to the water line to function as a platform.

The top 26 comprises a horizontally extending aft portion 39 and a smaller sloped forward portion 40 adjacent to the transom 24. As shown in FIGS. 3 and 4, the sloped portion 40 is provided for clearance for the exhaust pipes 22 which extend through the transom 24 of the boat. The top 26 also includes an upwardly extending portion 41 which extends upwardly from the sloped portion 40 adjacent to the transom 24 and terminates at the front upper portion of the sidewall portion 37 providing a downward step configuration from the stern.

The rear wall 27 is formed of outer portions 30 (FIGS. 1, 4) and an inner portion 31 (FIG. 3) which is recessed beneath the top 26. To support the rearward edge of the top 26 along the length in which the rear wall portion 31 is recessed, a tubular portion 42 is formed. The tubular portion 42 extends between the outer rear wall portions 30 directly beneath the aft end of the top 26.

A plurality of ports 44 and 45 are formed in the rear wall 27, with one port provided for each of the exhaust pipes 22. For the muffler 20 shown in FIGS. 1–4, four ports are provided, two outer exhaust ports 44 located in the outer rear wall portions 30, and two inner exhaust ports 45 located in the inner rear wall portions 31. The housing comprising the muffler 20 is hollow, providing a muffler chamber which comprises two outer chambers 47 as shown in FIG. 4 and two inner chambers 48 as shown in FIG. 3. The outer chamber 47 extends rearwardly from the transom 24 to the rearward edge of the top 26. The inner chamber 48 extends rearwardly from the transom 24 but terminates before the rearward edge of the top 26 due to the recess of the inner rear wall portion 31.

Within the inner and outer exhaust chambers 47 and 48, suitable muffler or baffle means may be provided. In the embodiment of the invention shown in FIGS. 3 and 4, opposed baffle means are employed. As shown in FIGS. 3 and 4, downwardly extending baffles 61 and 62 are mounted from the top 26 adjacent to the outer end of the exhaust pipe 22 to direct the exhaust downwardly, and upwardly extending baffles 63 and 64 are mounted from the bottom 28 rearward of the baffles 61 and 62 to reverse the flow of the exhaust.

Other alternative muffler means are shown in FIGS. 5–16.

Figure 6:
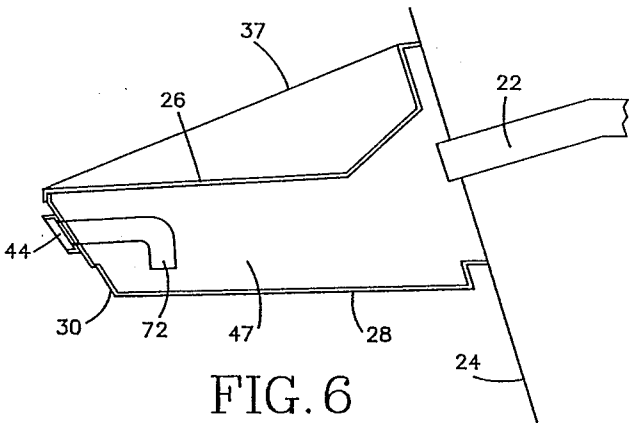
FIG. 6 is a side sectional view similar to FIG. 4 showing the alternative muffler design of FIG. 5.
Figure 5:
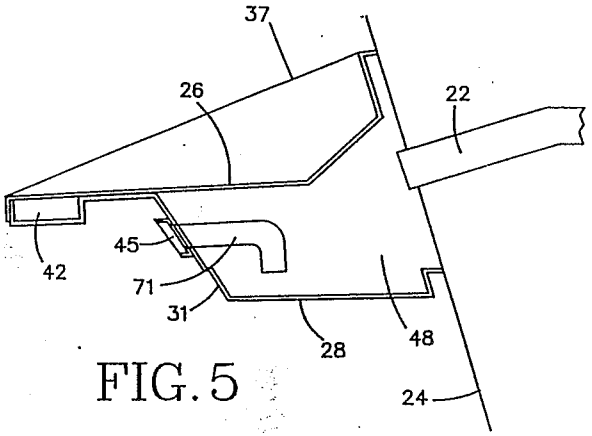
FIG. 5 is a side sectional view similar to FIG. 3 showing an alternate muffler design.

In the first alternative embodiment shown in FIGS. 5 and 6, downwardly projecting muffler pipes 71 and 72 extend from each of the exhaust ports 44 and 45. The pipes 71 and 72 each have a downward directed elbow so that the exhaust is redirected downwardly from the exhaust pipe 22, is mixed with water, and enters through the bottom of the pipes 71 and 72 before it exits through the ports 44 and 45.

Figure 8:
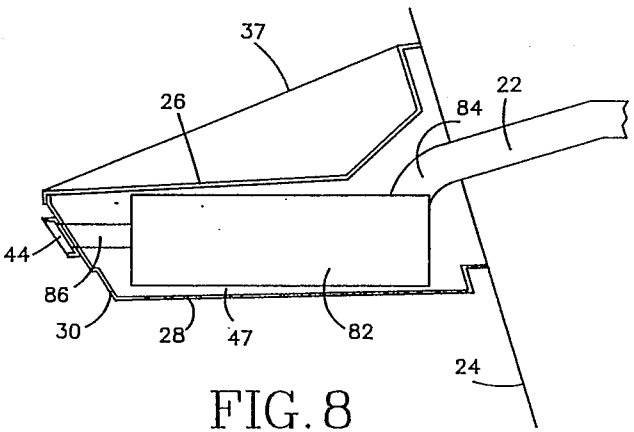
FIG. 8 is a side sectional view similar to FIG. 4 showing the second alternative muffler design of FIG. 7.
Figure 7:
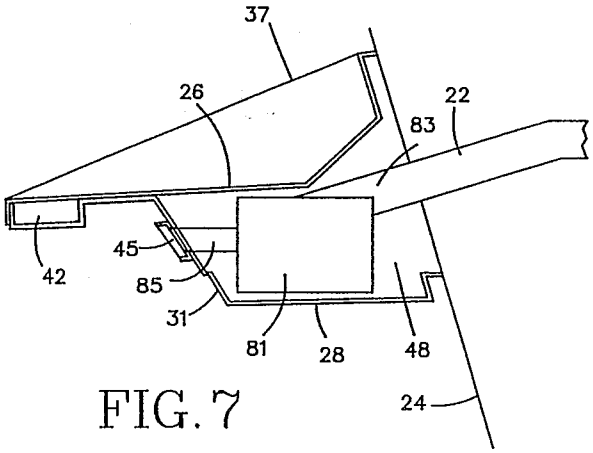
FIG. 7 is a side sectional view similar to FIG. 3 showing a second alternative muffler design.

In the second alternative embodiment shown in FIGS. 7 and 8, conventional muffler chambers 81 and 82 are employed within the chambers 47 and 48. Each muffler chamber has an entry pipe 83 or 84 connected directly to the outer end of one of the exhaust pipes 22 and has an exit pipe 85 or 86 connected to one of the ports 44 and 45.

Figure 10:
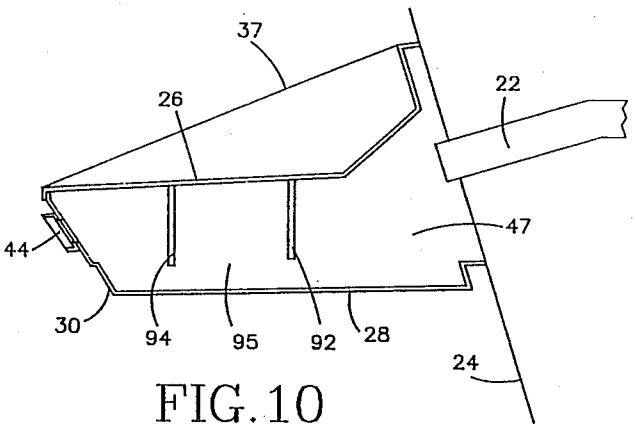
FIG. 10 is a side sectional view similar to FIG. 4 showing the third alternative muffler design of FIG. 9.
Figure 9:
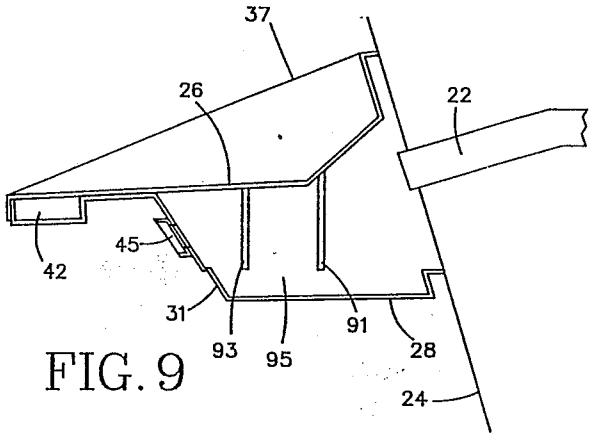
FIG. 9 is a side sectional view similar to FIG. 3 showing a third alternative muffler design.

In the third alternative embodiment shown in FIGS. 9 and 10, pairs of downwardly extending baffles 91–94 are mounted to the top 26. The exhaust from the exhaust pipes 22 strikes the first baffles 91 and 92 and is directed into the intermediate space 95 between the first baffles 91 and 92 and the second baffles 93 and 94. The exhaust then travels downwardly around the second baffles 93 and 94 before exiting through the ports 44 and 45.

Figure 12:
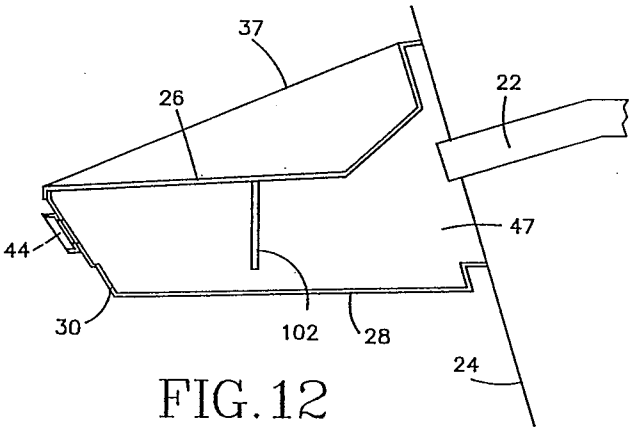
FIG. 12 is a side sectional view similar to FIG. 4 showing the fourth alternative muffler design of FIG. 11.
Figure 11:
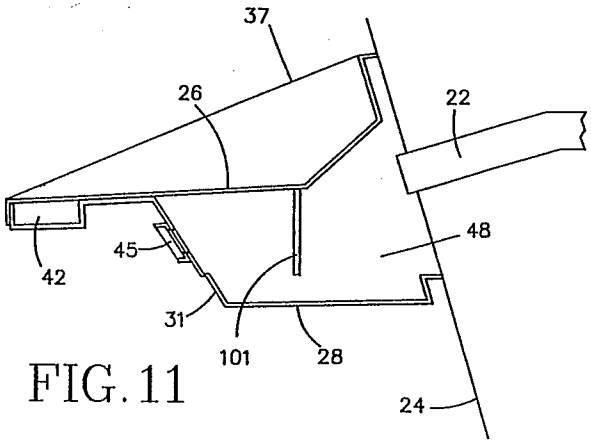
FIG. 11 is a side sectional view similar to FIG. 3 showing a fourth alternative muffler design.

In the fourth alternative embodiment shown in FIGS. 11 and 12, single extending baffles 101 and 102 are employed. Each of the baffles 101 and 102 is mounted to extend downwardly from the top 26. Exhaust from the exhaust pipes 22 strikes the baffles 101 and 102 and is directed downwardly around the baffles before exiting through the exhaust ports 44 and 45.

Figure 13:
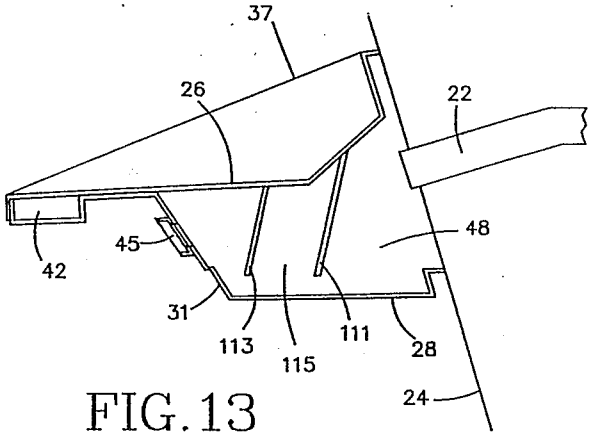
FIG. 13 is a side sectional view similar to FIG. 3 showing a fifth alternative muffler design.
Figure 14:
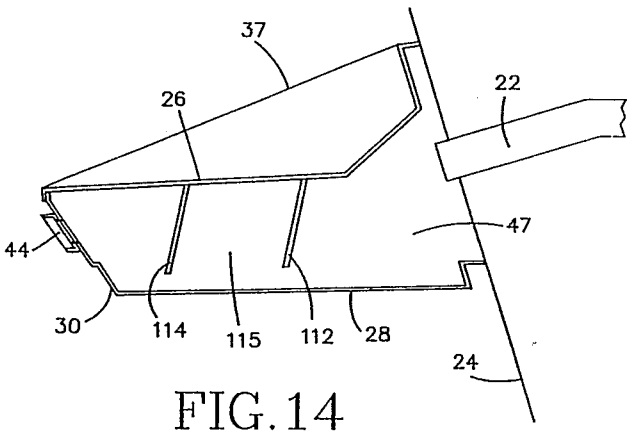
FIG. 14 is a side sectional view similar to FIG. 4 showing the fifth alternative muffler design of FIG. 13.
Figure 15:
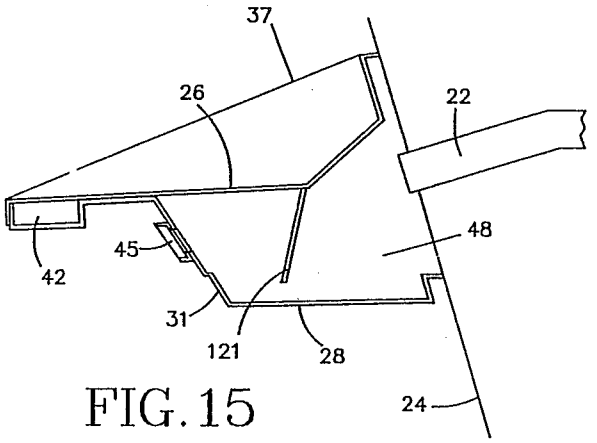
FIG. 15 is a side sectional view similar to FIG. 3 showing a sixth alternative muffler design.
Figure 16:
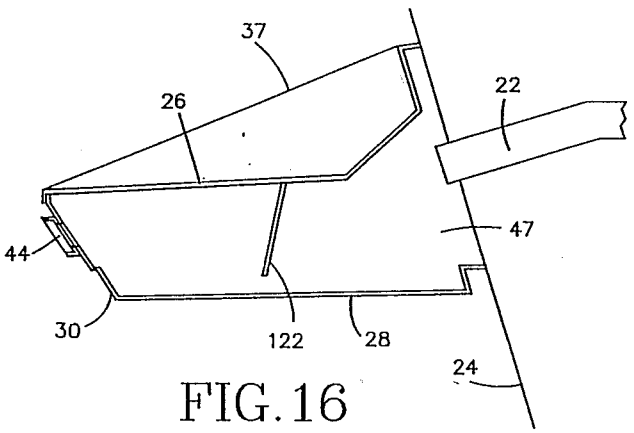
FIG. 16 is a side sectional view similar to FIG. 4 showing the sixth alternative muffler design of FIG. 15.

A fifth alternative muffler design is shown in FIGS. 13 and 14. This muffler design employs pairs of downwardly extending baffles comprising first baffle 111 or 112 and second baffles 113 and 114. In comparison to the baffles 91–94 shown in FIGS. 9 and 10, the baffles 111–114 are sloped rearwardly and thus produce a different flow through the chambers and result in different pressures within the chamber.

A sixth alternative muffler design is shown in FIGS. 11 and 12. This muffler design comprises single downwardly extending baffles 121 and 122. Unlike the downwardly extending baffles 101 and 102 shown in FIGS. 11 and 12, the baffles 121 and 122 are sloped rearwardly, producing more turbulence to the exhaust flow.

The particular design of the muffler means used within the chambers 47 and 48 depends upon the exhaust pressures provided through the exhaust pipe 22, the desired reduction in noise level, the back pressures experienced within the chambers and other factors which are known in the art. It is contemplated that one of the muffler designs shown herein or another suitable design will be employed within the housing to produce a suitable muffler which has the desired reduction and noise level without adversely affecting the perfomance of the marine engine. It is understood that a suitable muffler design can be chosen which will result in the desired reduction and noise level without producing undersirable back pressures which would adversely affect engine performance.

The exhaust of marine engines typically includes cooling water. Therefore, the design of the muffler should be such that it can accommodate the flow of cooling water mixed with exhaust gases which would pass through the muffler. Thus, it is important that the exhaust ports 44 and 45 provided in the rear wall of the muffler be positioned to permit the flow of water out of the muffler.

While a preferred design of the muffler of the present invention is mounted on the transom of an inboard or inboard/outboard motor boat, alternative designs are possible. For example, the muffler of the present invention may be integrally formed with the boat rather than attached to the exterior of the boat. Thus, the rear of the boat may include a housing integrally formed with the boat providing a top which is below the normal rear transom of the boat forming a swimming platform with a chamber being formed beneath this top, the chamber having a muffler means within to provide the advantages of the present invention.

Other modifications are possible. For example, a muffler may be designed for use on a boat having only a single exhaust pipe, in which case the rear wall would be provided with a single exhaust port.

The muffler of the present invention may also be employed with outboard engines in which the engine exhaust is provided through an exhaust pipe at the stern of the boat. With the exhaust pipe provided at the stern of the boat, the muffler of the present invention may be mounted on the transom to provide the benefits of the invention.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. An outboard exhaust muffler for a motor boat having an exhaust pipe through which exhaust is emitted through the transom above the water line at the stern, which comprises:

an enclosed housing located at the stern of the boat over the exhaust pipe into which the exhaust is emitted, the housing being attached to the transom and extending aft of the transom and aft of the boat, the space within the enclosed housing defining muffler means for reducing the noise of the exhaust, the housing comprising:

a pair of sidewalls each adjacent to one of the sides of the boat extending aft of the transom;

a top extending between the two sidewalls above the exhaust pipe, the top being above and near the water line and forming a swim platform;

a bottom extending between the two sidewalls below the exhaust pipe;

a rear wall extending from the top to the bottom between the two sidewalls, the rear wall having an exhaust port through which the exhaust leaves the enclosed housing.

2. An exhaust muffler as defined in claim 1, wherein the sidewalls of the housing include an upper sidewall portion extending above the top of the housing and sloping upwardly toward the transom.

3. An exhaust muffler as defined in claim 1, wherein the rear wall includes a recessed portion.

4. An exhaust muffler as defined in claim 3, wherein the recessed portion of the rear wall is located in the central portion of the housing.

5. An exhaust muffler as defined in claim 1, wherein the muffler means includes at least one baffle extending vertically directly rearwardly of the exhaust pipe.

6. An exhaust muffler as defined in claim 1, wherein the muffler means includes at least one baffle extending downwardly from the top of the housing.

7. An exhaust muffler as defined in claim 1, wherein the muffler means includes at least one baffle extending upwardly from the bottom of the housing.

8. An exhaust muffler as defined in claim 1, wherein the muffler means includes at least one baffle extending downwardly from the top of the housing in a rearwardly sloped direction.

9. An exhaust muffler as defined in claim 1, wherein the muffler means includes at least one baffle extending upwardly from the bottom of the housing in a rearwardly sloped direction.

10. An exhaust muffler as defined in claim 1 for a motor boat having a plurality of exhaust pipes, wherein there are a plurality of exhaust ports in the rear wall.

* * * * *